US005211039A

United States Patent [19]

Pellerin

[11] Patent Number: 5,211,039

[45] Date of Patent: May 18, 1993

[54] CONTINUOUS BATCH TYPE WASHING MACHINE

[75] Inventor: Norvin L. Pellerin, New Orleans, La.

[73] Assignee: Pellerin Milnor Corporation, Kenner, La.

[21] Appl. No.: 668,046

[22] Filed: Mar. 12, 1991

[51] Int. Cl.[5] ..... D06F 23/02

[52] U.S. Cl. ..... 68/27; 68/58; 68/140; 68/142

[58] Field of Search ..... 68/27, 58, 139, 140, 68/142

[56] References Cited

U.S. PATENT DOCUMENTS

| | | | |
|---|---|---|---|
| 1,251,567 | 1/1918 | Potthoff . | |
| 3,330,139 | 7/1967 | Schafer | 68/58 |
| 3,481,347 | 12/1969 | Corbett | 134/69 |
| 3,693,639 | 9/1972 | Corbett | 134/69 |
| 3,869,883 | 3/1975 | Rotter | 68/58 |
| 3,995,458 | 12/1976 | Grunewald et al. | 68/140 |
| 4,020,659 | 5/1977 | Bhavsar | 68/27 |
| 4,109,493 | 8/1978 | Hugenbrunch | 68/27 |
| 4,236,393 | 12/1980 | Katzfey | 68/27 |
| 4,494,265 | 1/1985 | Schmidt | 68/58 |
| 4,519,224 | 5/1985 | Seifert et al. | 68/27 |
| 4,856,302 | 8/1989 | Eck | 68/27 |

FOREIGN PATENT DOCUMENTS 516772 1/1940 United Kingdom .

*Primary Examiner*—Frankie L. Stinson
*Attorney, Agent, or Firm*—Vaden, Eickenroht, Thompson, Boulware & Feather

[57] ABSTRACT

There are disclosed alternate embodiments of a top transfer type continuous batch washing machine each comprising an inner housing made up of cylindrically shaped drums having inlets and outlets in their end walls connected to one another, and an outer housing having walls in its lower portion to form individual bath sections in which the lower portions of perforated outer walls of the drums are suspended. Scoops within the drums enable the drums to oscillate or rotate in one directional sense to permit the circulation of liquid through the goods and rotate in the opposite directional sense to transfer the goods through the outlet and into the inlet of the adjacent drum.

8 Claims, 6 Drawing Sheets

23
S
32
29
33
21
27
26
30
28
L
31
20
32
25
2
2
22
33
24

22
30B
33
30A
30D
30
30E
L
32

21
L
32
30A
30C
30
30D
30B
33

CONTINUOUS BATCH TYPE WASHING MACHINE

This invention relates generally to continuous batch type washing machines. More particularly, it relates to improvements in continuous batch type washing machines of the so-called top transfer type.

In a machine of this type shown in U.S. Pat. No. 4,236,393, assigned to the assignee of the present application, individual cylindrically shaped drums are each supported in end-to-end relation for rotation within individual outer housings or shells. The outer wall of each drum is perforated to immerse a batch of goods therein within bath liquid contained in the lower portion of the outer housing. Each drum has a central inlet and outlet in its opposite end walls so that successive batches of goods may be loaded into the machine through an inlet to the outer drum at one end of the machine, transferred to the next drum as a new batch is received therein, following each wash cycle, and ultimately unloaded from the machine through an outlet in the outer drum at the other end of the machine.

More particularly, a scoop in each drum is so constructed and arranged as to transfer the goods from one drum to its adjacent downstream drum, or unloaded from the endmost drum, in response to rotation of the drum in a predetermined directional sense following each wash cycle, while permitting the drums to be oscillated or rotated in only the opposite directional sense to permit the circulation of bath liquid therethrough, without transfer, prior to rotation in the one directional sense to transfer the goods.

Each of the drums has flanges extending outwardly from its inlet and outlet with the flanges of adjacent drums telescoping within one another. More particularly, the outer flanges of the end drums and the telescoping flanges of adjacent drums are supported for rotation by rollers and caused to rotate by chains about sprockets about the flanges.

Although this machine has enjoyed and continues to enjoy considerable commercial success, it is an object of this invention to provide a similar machine which may be manufactured for less cost and is of simpler construction which occupies less space.

These and other objects are accomplished, in accordance with the illustrated and preferred embodiments of this invention, by a machine of this type comprising an elongate outer housing or shell having an inlet and outlet in its opposite ends and lateral walls which divide at least its bottom portion into individual bath sections, and an elongate inner housing having a plurality of drums with the outlet of each connected to the inlet of an adjacent drum, so as to provide a through opening therebetween, or opening to the outside of the outlet end of the outer housing. More particularly, the outer ends of the end drums of the inner housing which are external to the outer housing are rotatably supported so as to suspend the lower portion of each drum within an individual bath section. In the preferred and illustrated embodiments of the invention, the intermediate drums need not be supported and only the outer ends of the end drums are engaged by drive systems for rotating the inner housing in the desired manner. Thus, in addition to being of less length than prior machines of this type, the machine of the present invention has less parts and is thus of less expensive construction.

As in the case of the individual drums of the machine of the aforementioned patent, each drum has a scoop extending between its side walls which is so constructed and arranged relative to the inlet and outlet of the drum as to permit the circulation of liquid in the bath section of the outer housing through the goods in the lower portion of the drum, while preventing transfer of the goods to the adjacent drum, in response to rotation of the drum in the one directional sense or oscillation of the inner housing within predetermined rotational limits, and transfer goods therein into the adjacent drum or out of the outer housing, in response to rotation of the inner housing in the opposite directional sense.

In the illustrated and preferred embodiments of the invention, the machine further includes a second elongate outer housing similar to the first mentioned outer housing and having its inlet generally aligned with the outlet from the first outer housing, and a second elongate inner housing having a plurality of drums similar to those of the first mentioned inner housing and having the outer ends of the end drums which are external to the second outer housing rotatably supported with their lower ends of the drums within the bath sections thereof and engaged by drive means for rotating the second inner housing in opposite directions. More particularly, the outer end of the inlet drum of the second inner housing is supported in end to end relation with the outer end of the outlet drum of the first inner housing so that goods are transferred from the first inner housing to the second inner housing.

In accordance with one embodiment of the machine, the outlet end drum of the first inner housing and inlet drum of the second inner housing are supported independently of one another and rotated by separate drive means. In accordance with another embodiment of the invention, one of the outlet drum of the first inner housing and the inlet drum of the second inner housing is supported from the other, and only the other of the outlet drum and inlet drum is engaged by the drive means.

In the drawings, wherein like reference characters are used throughout to designate like parts:

FIG. 1 is a vertical sectional view of the first mentioned embodiment of a machine constructed in accordance with the present invention, with the inlet to the machine at its right-hand end and the outlet from the machine at its left-hand end;

FIGS. 2 and 3 are cross-sectional views of the machine, as seen along broken lines 2—2 of FIG. 1, with FIG. 2 showing the scoop in one of the drums positioned to transfer goods to an adjacent drum while receiving goods from the other adjacent drum, and FIG. 3 showing the scoop rotated in a direction to pick up goods from the bottom of the drum preparatory to transferring them following a wash cycle;

Figure 1:
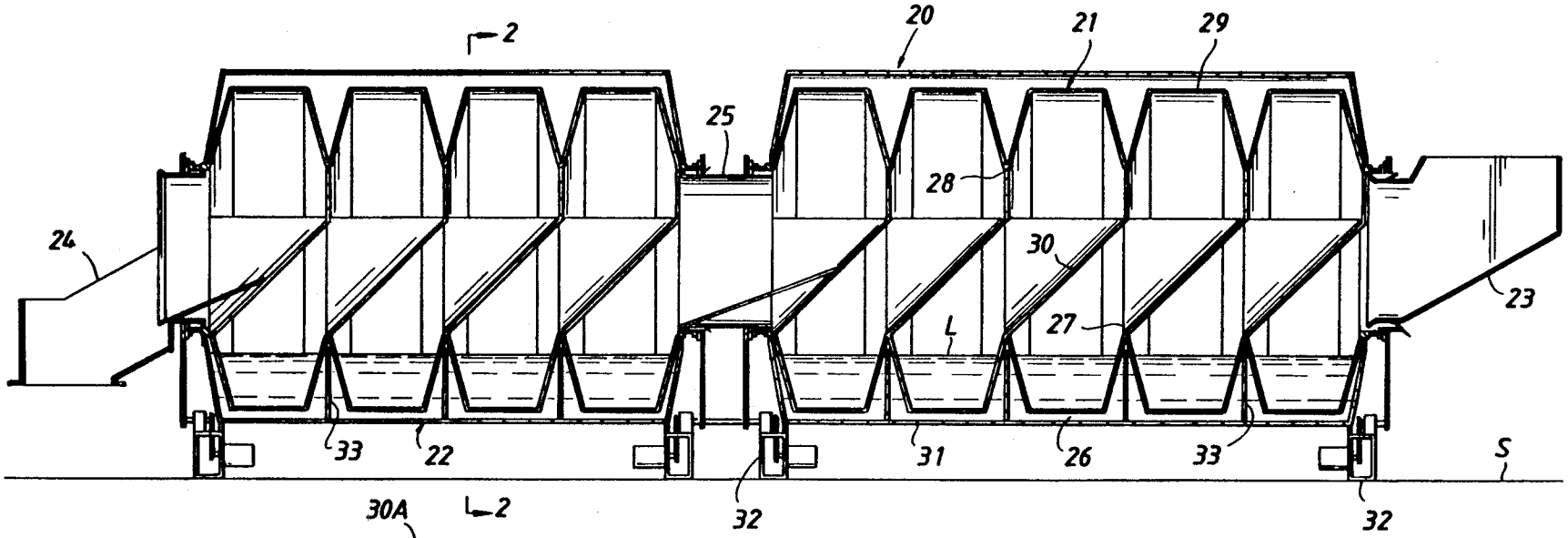

With reference now to the details of the above described drawings, the embodiment of the machine shown in FIG. 1 and indicated in its entirety by reference character 20 comprises a pair of end-to-end inner housings 21 each supported within an outer housing 22 of a pair of end-to-end, generally aligned outer housings. As also shown in FIG. 1, there is a chute 23 at its right-hand end through which goods may be loaded into the machine, as well as a chute 24 at its outlet end through which goods may be unloaded from the machine. The machine also includes a transitional portion 25 which enables goods discharged from the downstream end of the upstream inner housing to be discharged into the upstream end of the downstream inner housing.

As previously indicated, and as best shown in FIG. 1, each inner housing 21 is made up of a plurality of substantially cylindrically shaped drums 26 having central inlets 27 and outlets 28 in their end walls which are connected to one another to provide through openings therebetween and an outer perforated wall 29 connecting the end walls. A scoop 30 is mounted within each drum and extends between its end walls for the purpose of transferring goods from the drum to an adjacent drum or to an outlet from the machine in the case of the endmost downstream drum. A detailed description of the construction of the scoop and the manner in which it functions to transfer goods will be described to follow.

The outer housing 22 in which each inner housing 21 is supported comprises a generally cylindrical shell 31 supported above surface S by means of U-shaped pedestals 32 at each end. The shell is made up of upper and lower semi-cylindrical sections so that the upper section may be removed for access to the interior of the machine. As best shown in FIG. 1, each outer housing also includes walls 33 which extend laterally across the lower portion of the shell to divide the housing into individual bath sections each to contain a liquid in which the goods are to be treated.

More particularly, the walls are so arranged along the length of the outer housing as to extend upwardly between the oppositely facing end walls of the lower portions of adjacent drums. Thus, with the bath sections filled with liquid to the level L, the liquid is permitted to circulate through the goods in the lower portions of the drums as the drums are rotated within the outer housing.

As will be appreciated, and as well known in this art, the liquid contained in the bath sections may vary from one to the other lengthwise of the machine, depending on the stage of the wash cycle to be performed in those drums. Thus, the liquid in the upstream drums may contain prewash liquid, those drums downstream of the prewash bath sections may contain wash liquid, and subsequent bath sections near the outlet end of the machine may contain rinse liquid. In machines of this type, the liquids are ordinarily circulated from one bath section to another, often in counterflow relation to the direction of goods through the machine. Also, of course, the machine would be provided with means for adding detergents, dyes, and other additives to the bath sections.

Figure 3:
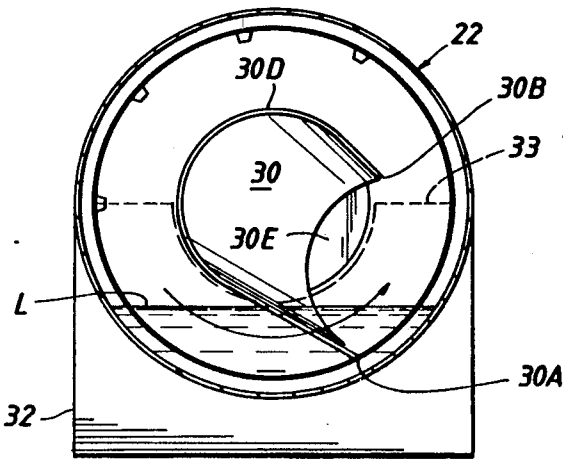
Figure 2:
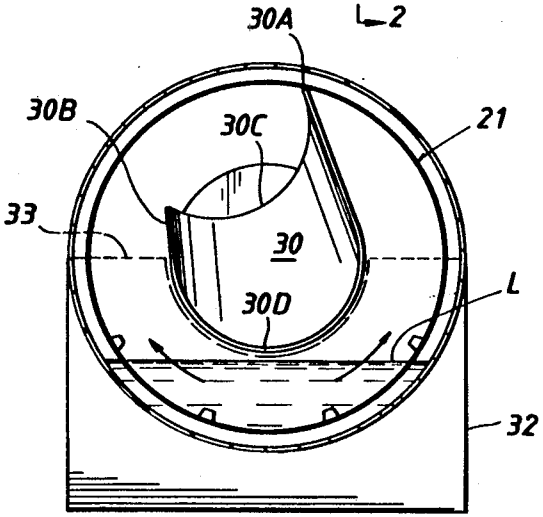
Figure 5:
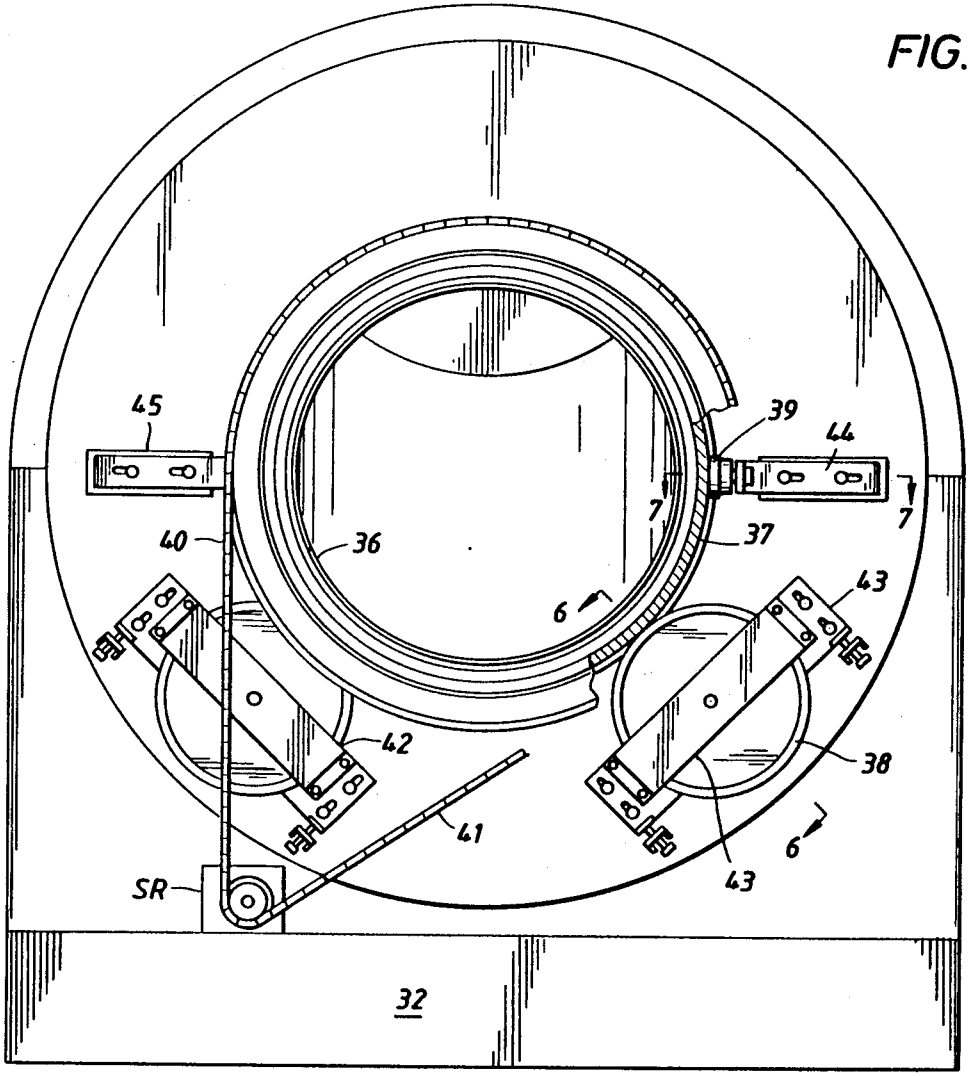
FIG. 5 is an elevational view of the inlet end of the machine, as seen along broken lines 5—5 of FIG. 4, with a portion of the mechanism for supporting and driving the drum broken away for purposes of illustration.

As shown in FIGS. 2 and 3, each wall 33 has an arcuate central edge 34 which fits relatively closely to the lower sides of the connected outlet and inlet in the oppositely facing end walls of the adjacent drums. More particularly, each partition wall preferably extends upwardly along opposite sides of the central edge 34 to uppermost edges arranged along a diameter of the drum which passes through its axis, thus permitting a pair of walls to be formed from a single circular sheet of metal. There is no exchange of liquid from one bath section to another, even during rotation of the drums, because the liquid level L is below the edge 34. Also, there is only a small space between the arcuate edge and the lower sides of the connected inlets and outlets of adjacent drums.

As best shown in FIGS. 2 and 3, as well as in U.S. Pat. No. 4,236,393, each drum includes a scoop which has a curved sheet having one side edge 30A secured to the outer wall of the drum and another side edge 30B which is spaced from the outer wall. In the transfer position of the scoop, it slants downwardly from the inlet end wall of the drum to the outlet end wall. More particularly, its upper end edge 30C is joined to the inlet end wall a short distance beneath the upper edge of the inlet, and its lower end edge 30D is joined to the outlet end wall adjacent the lower periphery of the outlet. The portion of the inlet above edge 30C is closed by a wall 30E to prevent goods entering the drum from passing directly through it rather than into the drum below the scoop.

During a wash cycle, the drum may be oscillated between alternate positions to opposite sides of its discharge or transfer position shown in FIG. 2, or alternatively, rotated in a clockwise direction so as to permit the bath liquid to be circulated through the goods in the lower portion of the drum, but without transferring the goods out of the drum. Then, upon completion of the wash cycle, goods may be transferred out of the drum by rotation in a counter-clockwise direction. Thus, as shown in FIG. 3, rotation of the drum in this direction permits the scoop to pick up goods in the bottom portion of the drum and raise them from the position of FIG. 3 to the position of FIG. 2, at which time the goods slide down the inclined portion of the scoop into the next downstream drum or out of the machine in the case of the endmost drum. If desired, the portion of the scoop which is lowermost during transfer may also be perforated, thus minimizing the amount of liquid which is transferred out of the drum in the transfer position of the scoop.

Figure 4:
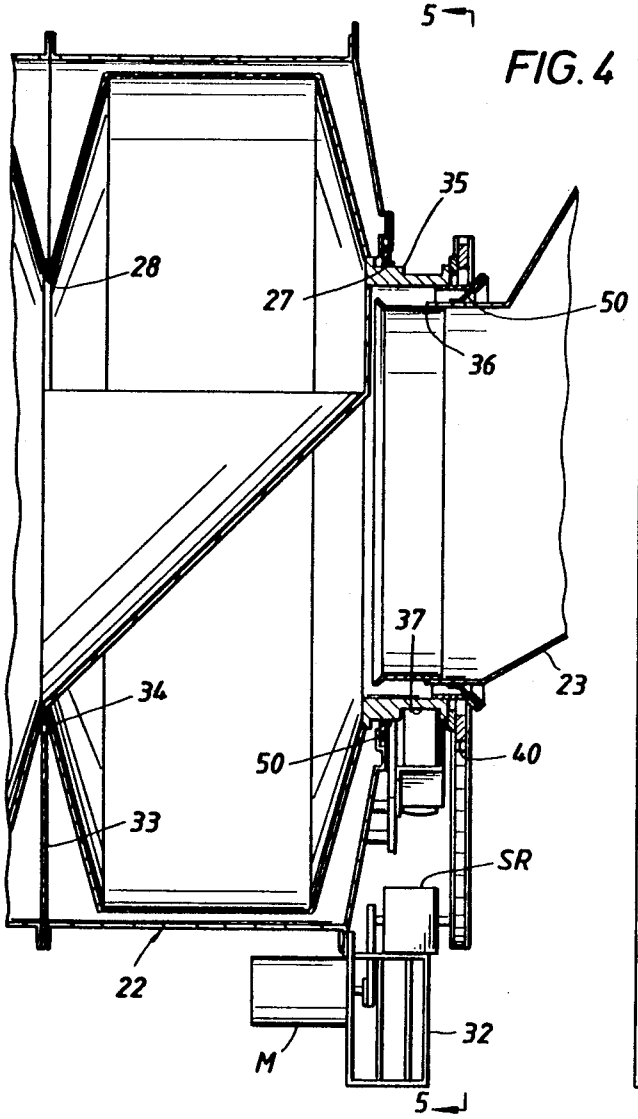
FIG. 4 is an enlarged cross-sectional view of the inlet end of the machine with the end drum shown rotated to a position for transferring goods to an adjacent drum as it receives goods from a loading chute leading to its inlet.

As shown in FIG. 4, the inlet drum of the upstream inner housing 21 has a flange 35 which extends outwardly from the inlet 27 to the drum to form the upstream outer end of the inner housing which extends through the inlet to the upstream end wall of the upstream outer housing. A cylindrical inner extension 36 of the outlet from the loading chute 23 is received within the flange to load goods into the lower portion of the drum in its transfer position.

Figure 6:
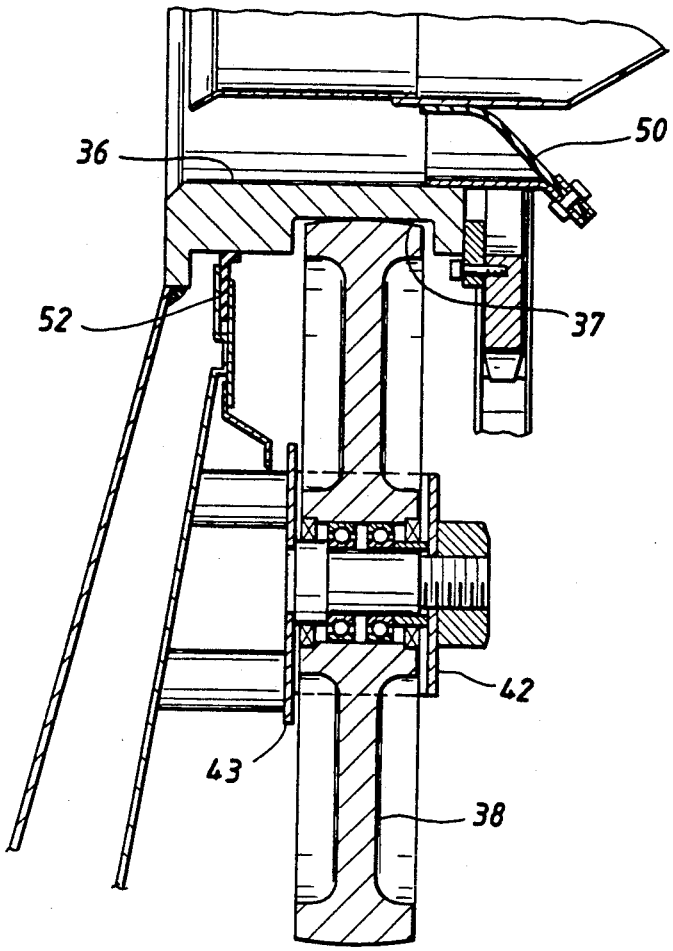
FIG. 6 is a further enlarged cross-sectional view of a portion of the drum and support rollers therefor, as seen along broken lines 6—6 of FIG. 5.
Figure 7:
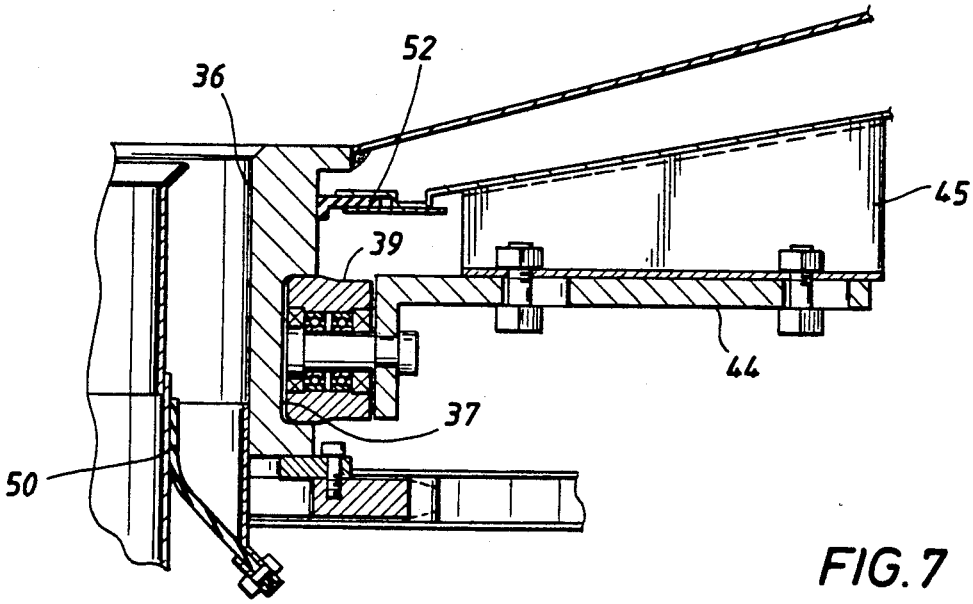
FIG. 7 is another cross-sectional view showing axial guide rollers for the drum, as seen along broken lines 7—7 of FIG. 5.

The flange 35 has an annular groove 37 thereabout which is outside of the outer housing and positioned to receive a pair of rollers 38 rotatably mounted on the outer wall of the outer housing. As best shown in FIG. 6, the rollers engage within the groove at opposite sides of the lower portion of the drum to support it for rotation about its axis. As best shown in FIG. 7, additional rollers 39 are mounted on the outer side of the upstream end wall of the outer housing to engage within the annular groove 37 at opposite diametrical sides of the drum to limit axial movement of the drum and thus the inner housing with respect to the outer housing.

Figure 8:
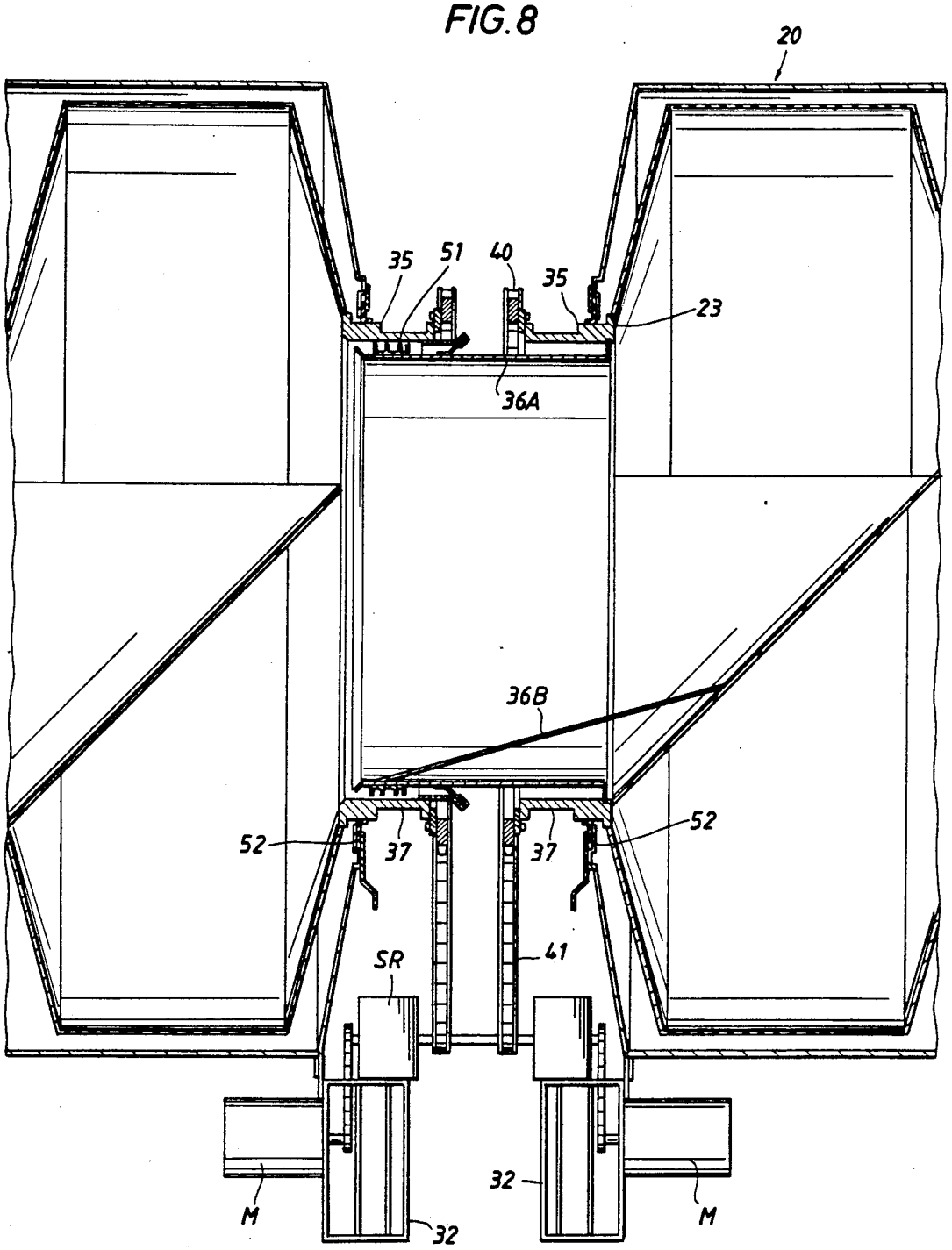
FIG. 8 is a vertical sectional view of a mid-portion of the machine including a connection between the outlet drum in one inner housing with the inlet drum in the other inner housing of the machine.

As shown in FIG. 8, the outer end of the outlet drum on the opposite end of the upstream inner housing also has a flange 35 which extends outwardly from its outlet 28 and has a similar groove 37 formed thereabout to receive support rollers 38 as well as limit rollers 39 mounted on the outer end wall of the downstream end of the outer housing. Thus, as previously described, the upstream inner housing is supported for rotation only at its opposite outer ends which are external to the outer housing, the intermediate drums being freely suspended within individual bath sections.

Each end of the upstream inner housing of the machine is adapted to be rotated in opposite directions by means of a sprocket 40 mounted about the flange 35 outwardly of the groove 37, and a chain 41 disposed about the sprocket and driven by means of a motor M mounted on the pedestal 32 of the outer housing through a speed reducer 38 whose output shaft is engaged with the sprocket. Thus, as also previously described, the upstream inner housing is rotated at only its opposite outer ends so that no portion of the drive system is inside of the outer housing. The motor is of the reversible type to enable the inner housing and thus the drums thereof to be rotated in the desired directions during, wash and transfer cycles.

Figure 9:
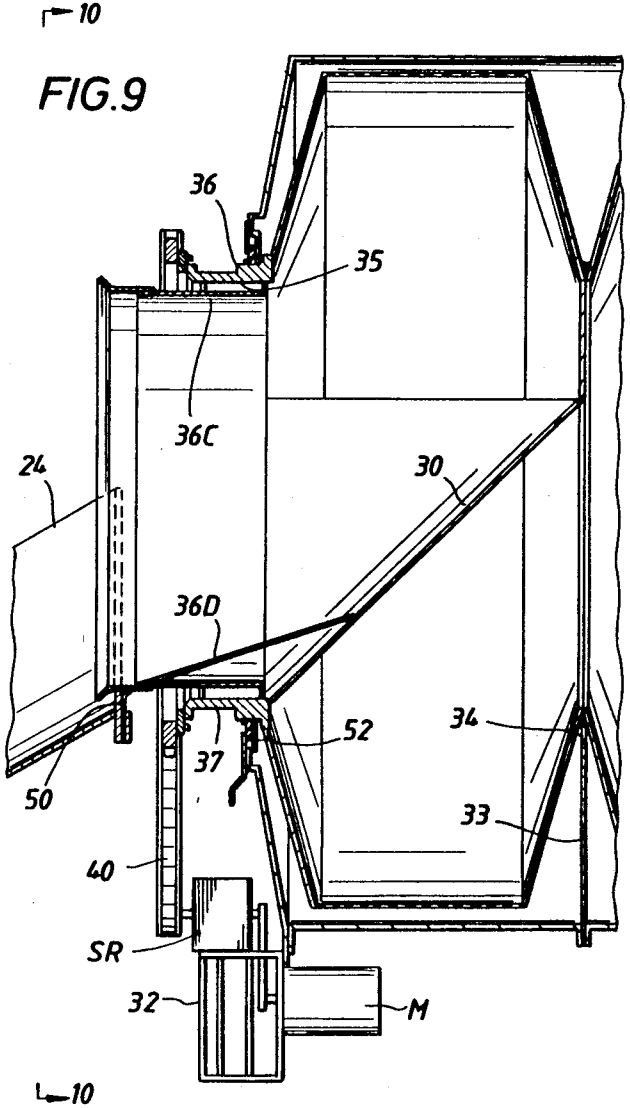
FIG. 9 is a vertical sectional view of the outlet end of the machine and showing the drum at the outlet end of the downstream inner housing in transfer position.
Figure 10:
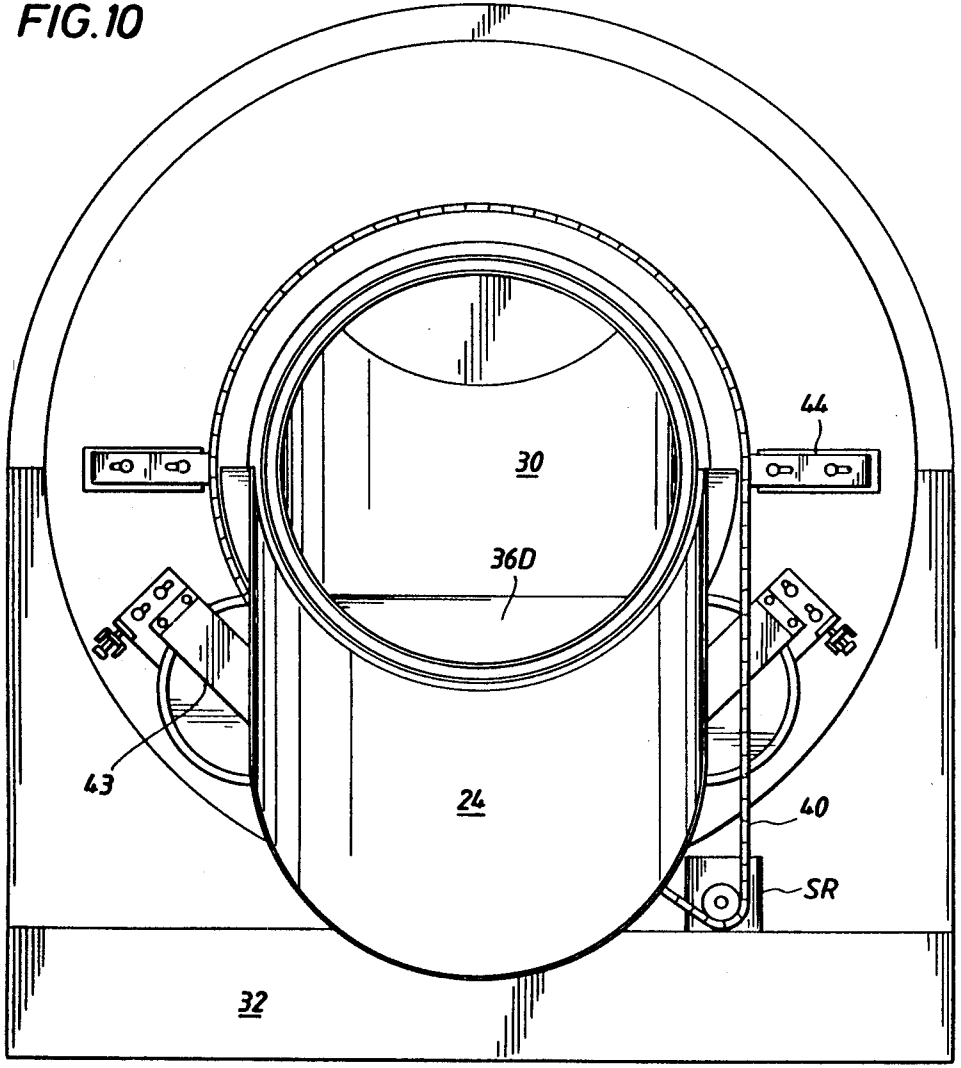
FIG. 10 is a view of the outlet end of the machine, as seen along broken lines 10—10 of FIG. 9.

As shown in FIG. 8, as well as FIGS. 9 and 10, the opposite ends of the downstream inner housing of the machine are rotatably supported and driven in the same manner as the upstream inner housing. Thus, a flange 35 extends outwardly from the inlet of the upstream end drum of the downstream housing as well as from the outlet of the downstream end drum thereof. More particularly, each such flange has a groove 37 formed therein outwardly of the outer ends of the downstream outer housing, and rollers 38 and 39 are mounted on the outer sides of the opposite ends of the downstream outer housing to support the downstream inner housing for rotation about its axis and to prevent its axial movement out of supported position. The outwardly extending flanges 35 at opposite ends of the downstream inner housing also have sprockets 40 mounted thereabout outwardly of the groove 37 and chains 41 disposed about the sprocket and about an output shaft of a speed reducer connected with a motor M for so rotating the chain.

As best shown in FIG. 4, the shaft of each of the support rollers 38 is mounted on a bracket 42 releasably attached to a mounting plate 43, which in turn is connected to the end wall of the adjacent end wall of the outer housing for radial adjustment inwardly and outwardly with respect to the drum flange. As best shown in FIG. 7, each of the rollers 39 is rotatably supported by an L-shaped bracket 44 attached to a flange mounting 45 on the outer side of the outer end of the outer housing, whereby the rollers 39 may be moved radially into and out of the groove 37.

The flanges 35 shown in FIG. 8 on the outlet end of the upstream inner housing and inlet end of the downstream inner housing surround a cylindrical extension 36A of the outlet from the downstream drum of the upstream inner housing. Also, a plate 36B is mounted on the extension 36A and extends between one end within the inner face of the scoop of the downstream drum of the upstream inner housing and through the outlet of the drum for connection at its opposite end to the inner diameter of the cylindrical extension 36A near its outlet end. Wall 36B thus forms a smooth transition for the transfer of goods from the end drum of the upstream inner housing to the end drum of the downstream inner housing.

As shown in FIG. 9 and 10, the flange 35 extending outwardly from the end drum of the downstream inner housing surrounds an inner cylindrical extension 36C thereof which extends beyond the inner end of the unloading chute 24 so as to prevent goods from dropping between the end drum and the chute. Also, a wall 36D connected to the extension bridges the outlet from the end drum to provide a smooth transition between the scoop and the extension 36C near its outer end.

As best shown in FIG. 6, the annular space between the inner extension 36 of the loading chute 23 and the flange 35 extending outwardly from the inlet end of the outer drum of the upstream inner housing is closed to prevent bath liquid from escaping therebetween. Thus, one end of a lip type seal 50 of resilient material is mounted on the flange 35 and bent over at its opposite end to form a sliding seal with the outer diameter of the extension 36. As shown in FIG. 8, a similar lip type seal 50 is mounted on the outwardly extending flange 35 on the outer end of the end drum of the downstream inner housing to prevent the escape of liquid through the space between the extension 36A and the flange 35 of the drum. Additional protection against leakage may also be provided by a labyrinth type seal 51 carried about the extension 36A.

The opposite end of the extension will of course close the annular space between the flange 35 of the downstream drum of the upstream inner housing and the extension 36A. The annular space between the flange 35 extending outwardly from the downstream drum of the downstream inner housing and the extension 36C within the flange is closed at its inner end by the out turned flange of the extension 36C.

Figure 11:
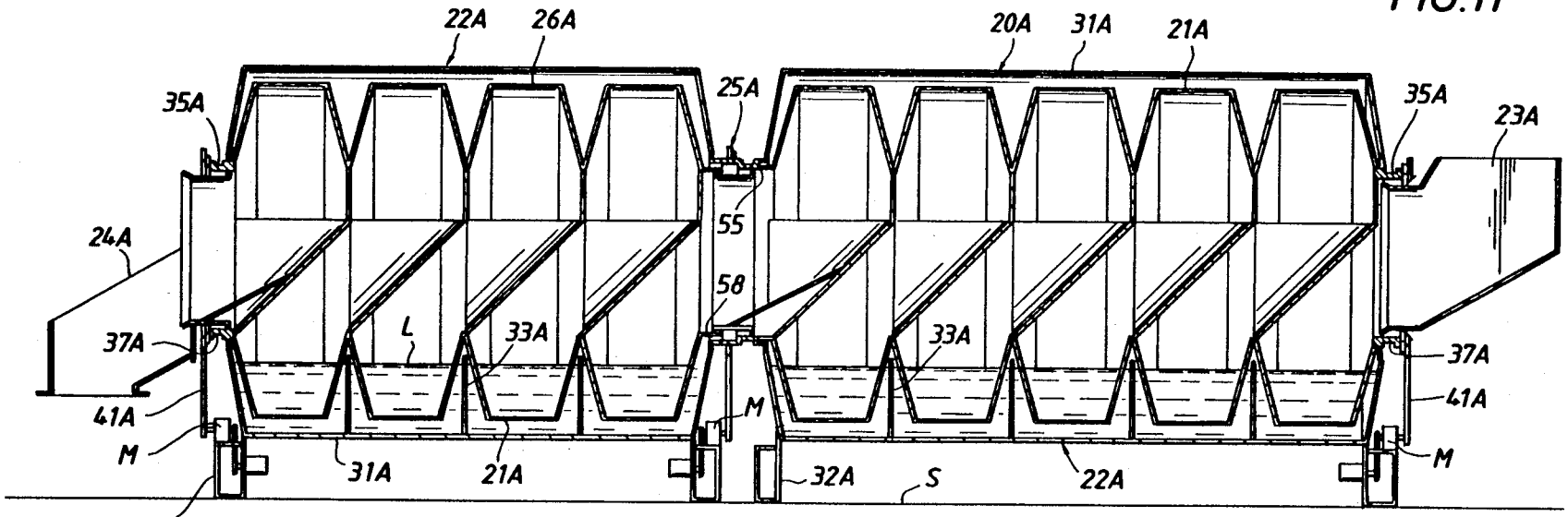
FIG. 11 is a vertical sectional view similar to FIG. 1, but of the second mentioned embodiment of the machine.

The embodiment of the machine shown in FIG. 11, and indicated in its entirety by reference character 20A comprises, as in the previously described embodiment, a pair of end-to-end housings 21A each supported within an outer housing 22A of a pair of end-to-end, generally aligned outer housings, a chute 23A at the inlet end of the machine through which goods may be loaded, and a chute 24A at its outlet end through which the goods may be unloaded. The machine further includes a connection or transitional portion 25A which, as best illustrated and described in connection with FIG. 12, is of such construction as to enable goods discharged from the downstream end of the upstream inner housing into the upstream end of the downstream inner housing.

Each inner housing 21A is made up of a plurality of drums 26A substantially identical in construction to the drums 26 of the first-described embodiment. Thus, each drum has an inlet in one end wall and an outlet in the other end wall with the outlets and inlets of the adjacent intermediate drums being connected to one another to form through openings between them. Thus, the inlet drum of the upstream inner housing receives goods from the loading chute of the machine, the outlet drum of the upstream inner housing transfers goods into the inlet drum of the downstream inner housing, and the outlet drum of the downstream inner housing transfers goods into the outlet chute from the machine. The outer wall of each drum which connects its end walls is perforated, and a scoop is mounted within and so arranged in each drum as to transfer goods from the drum to an adjacent downstream drum or to the outlet from the left-hand end of the machine, as described in connection with the scoop of the drums 26 of the first-described embodiment.

The outer housing 22A in which each housing 21A is supported comprises a generally cylindrically shaped shell 31A supported above surface S by means of U-shaped pedestals 32A at each end. The shell is identical to the shell 32 of the previously described embodiment in that it is made up of upper and lower semi-cylindrical sections. Furthermore, each outer housing 22A includes walls 33A which extend laterally across the lower portion of the shell between the oppositely facing end walls of the lower portions of adjacent drums to divide the outer housing into the individual bath sections in which the lower portion of the drums are disposed.

Figure 12:
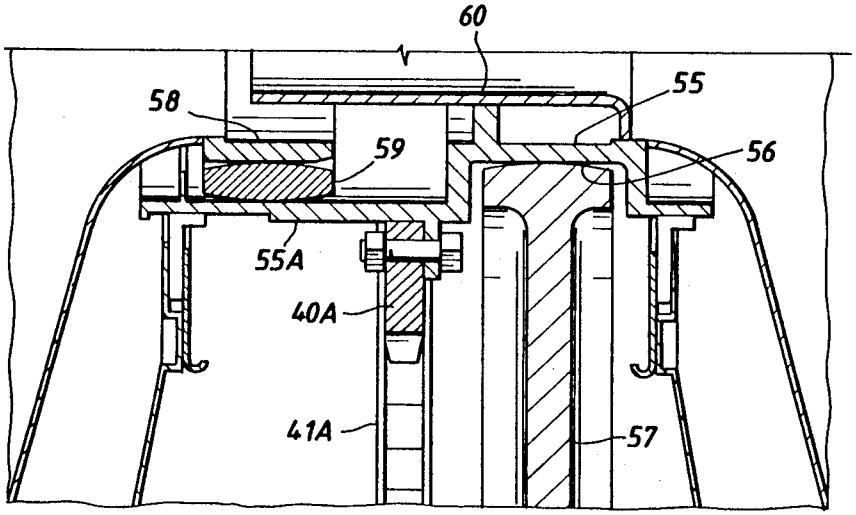
FIG. 12 is an enlarged view of a portion of the connected ends of the inner housings of the machine shown in FIG. 11.

Although not illustrated in FIGS. 11 and 12, it will be understood that each wall 33A is similar to walls 33 of the previously described embodiment in that they have arcuate central edges which fit relatively closely to the lower sides of the connected outlet and inlet in the oppositely facing end walls of adjacent drums. More particularly, each such wall extends upwardly along the opposite sides of its central edge to uppermost edges which are on a diameter of the drum which passes through its axis. Consequently, as previously described, there is no exchange of liquid from one bath section to another, even during rotation of the drums, since the liquid level L is below the edge 34. The drums of the inner housings may be rotated in a manner previously described in order to permit liquid to be circulated through the goods in the drums, during a wash cycle, and then to be transferred from the drum into an adjacent downstream drum, or out the outlet end of the machine.

The inlet drum of the upstream inner housing 21A has a flange 35A which extends outwardly from its inlet to form the upstream outer end of the upstream inner housing which extends through the inlet to the upstream end wall of the upstream outer housing. As in the case of the first-described embodiment, and as shown in FIG. 11, a cylindrical inner extension of the outlet from the loading chute 23A is received within the flange 35A of the inlet drum to load goods into the lower portion of the drum when in its transfer position.

This flange has an annular groove 37A about it outside of the outer housing and positioned to receive a pair of rollers rotatably mounted on the outer wall of the outer housing, as described and shown in connection with the first-described embodiments, so as to support the inlet drum of the upstream inner housing for rotation about its axis. As will also be understood, additional rollers may be mounted on the outer side of the upstream end of the outer housing to engage within the groove 37A at opposite diametrical sides of the drum to limit its axial movement, again as previously described in connection with the first embodiment.

As shown in FIGS. 11 and 12, a flange 55 extends outwardly from the outlet of the outlet drum of the upstream inner housing 21A for extension outwardly through the outlet end wall of the upstream inner housing. Similarly to the flange 35A on the opposite outer end of the inner housing, there is a groove 56 thereabout to receive support rollers 57 (FIG. 12) as well as limit rollers (not shown) mounted on the end wall of the outlet end of the upstream housing. Thus, as in the case of the first-described embodiment, the upstream inner housing is supported for rotation only as its opposite outer ends which extend outwardly from the upstream outer housing, the intermediate drums being freely suspended within individual bath sections.

A flange 58 extends outwardly from the inlet to the inlet end drum of the downstream inner housing for fitting within an enlarged outer end 55A of the flange 55. More particularly, the flange, which provides an inlet to the downstream inner housing, is supported for rotation within the flange 55 by means of a ring 59 disposed between the outer diameter of the flange 58 and the inner diameter of an extension 55A of flange 55. As shown in FIG. 12, a tubular member 60 carried within the flange 55 provides a smooth transition for the transfer of goods from the outlet drum of the upstream inner housing into the inlet drum of the downstream inner housing.

A flange 35A extends outwardly from the outlet drum of the downstream inner housing for extension outwardly through the outer end of the upstream outer housing. This flange may be identical to the flange 35A at the inlet to the inlet drum of the upstream inner housing. Additionally, the outlet drum of the downstream inner housing has a tubular extension mounted thereon for extension through the flange 35A in order to provide a smooth transfer of goods from the outlet drum into the outlet chute 24A. Reference is made to FIG. 9 for a detailed description of this construction of the outlet drum of the downstream inner housing.

As described in connection with the flange on the outer outlet end of the outlet drum of the downstream inner housing of the first embodiment (see FIG. 9), the flange 35A is also similar to the flange 35A at the inlet to the upstream inner housing in that it is supported by rollers which fit within a groove 37A thereabout. Also, additional rollers fit within the groove to restrain axial movement of the downstream inner housing.

A sprocket is mounted about the flange 35A at the inlet to the inlet drum of the upstream inner housing, and a chain 41A disposed about the sprocket is driven by means of a motor M mounted on the upstream pedestal 32A so as to rotate the inlet end of the upstream inner housing, as described in connection with the first embodiment of the invention. The outlet end of the upstream inner housing is also adapted to be rotated by means of a chain 41A disposed about a sprocket 40A mounted about the flange 55, as shown in FIGS. 11 and 12. This chain is in turn driven by another motor M mounted on the pedestal 32A at the upstream end of the downstream inner housing. Thus, as in the case of the first-described embodiment of the invention of the machine, the upstream inner housing is engaged by drive means at both ends for rotating it in the desired manner.

As shown in FIG. 11, the outlet drum of the downstream inner housing is adapted to be rotated by means of a chain 41A disposed about a sprocket mounted about the flange 35A extending from the outlet of the drum and driven by a motor M on the downstream pedestal 32A. Reference to a more detailed description in this regard may be had to FIG. 9. However, as previously mentioned, the inlet end drum of the downstream inner housing is not engaged by drive means for rotating it, so that the drive means at the outlet end drum is the sole means for rotating the downstream inner housing.

As indicated in FIG. 12, the outer ends of the outer housing are sealed with respect to the flange 55 at the outlet end of the upstream inner housing so as to prevent bath liquid from escaping between them. The opposite ends of the inner housings may of course be similarly sealed off, in a manner apparent from the foregoing description of the first embodiment of the invention.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A continuous batch type washing machine of the top transfer type, comprising an elongate outer housing having an inlet at one end, an outlet at the other end, and lateral walls dividing at least its bottom portion into individual bath sections, a continuous elongate inner housing comprising a plurality of generally cylindrically shaped drums each having a perforated outer wall, an inlet in one end wall through which goods may enter the drum, and an outlet in its other end wall connected to the inlet of an adjacent drum, so as to provide a through opening therebetween, or opening to the outside end of the outer housing, means rotatably supporting only the outer ends of end drums of the continuous elongate inner housing which are external to the bath sections of the outer housing so as to suspend the lower portion of each drum within an individual bath section, and drive means engaging only the outer ends of the end drums for rotating the inner housing in opposite directional senses, each drum having a scoop extending between its side walls and so constructed and arranged relative to the inlet and outlet of the drum as to permit the circulation of liquid within the bath section through the goods, while preventing transfer of the goods through the drum outlet, in response to rotation of the inner housing in one directional sense or limited oscillation of the inner housing, but transfer goods through the outlet, in response to rotation of the inner housing in the opposite directional sense.

2. A machine of the character defined in claim 1, wherein a portion of each scoop is perforated.

3. A machine of the character defined in claim 1, wherein each lateral wall of the outer housing has an arcuate central edge close to the connected inlet and outlet of adjacent drums.

4. A machine of the character defined in claim 1, including a second elongate outer housing having an inlet at one end generally aligned with the outlet of the first outer housing, an outlet at the other end, and lateral walls dividing its bottom portion into individual bath sections, a second elongate inner housing having a plurality of generally cylindrically shaped drums, means rotatably supporting only the outer ends of the end drums of the second inner housing which are external to the bath sections of the second outer housing so as to suspend the lower portion of each drum within an individual bath section of the second outer housing, drive means engaging only the outer ends of the end drums for rotating the second inner housing in opposite longitudinal directions, and each drum of the second inner housing also having a perforated outer wall, an inlet and outlet, and a scoop extending between its end walls, and the outer end of the inlet drum of the second inner housing being in end to end relation with the outer end of the outlet drum of the first inner housing whereby goods may be transferred from the first inner housing to the second inner housing.

5. A machine of the character defined in claim 4, wherein the outlet drum of the first inner housing and the inlet drum of the second inner housing are supported independently of one another and rotated by separate drive means.

6. A machine of the character defined in claim 4, wherein one of the outlet drums of the first inner housing and the inlet drum of the second inner housing is supported from the other, and only the other of the outlet drum and inlet drum is engaged for rotating by drive means.

7. A machine of the character defined in claim 1, wherein the outer ends of the end drums comprise an outwardly turned cylindrical flange on the end wall thereof having a groove thereabout, and the supporting means comprises rollers engaging within each groove.

8. A machine of the character defined in claim 7, wherein the rotating means includes a sprocket about each flange, and a motor driven chain about each sprocket.

* * * * *